US005790980A

United States Patent [19]

Yewer, Jr.

[11] Patent Number: 5,790,980

[45] Date of Patent: Aug. 11, 1998

[54] PADDED GLOVE

[76] Inventor: Edward H. Yewer, Jr., 6259 N. Hwy. 83, Hartland, Wis. 53029

[21] Appl. No.: 792,641

[22] Filed: Jan. 31, 1997

[51] Int. Cl.[6] ..... A41D 13/10

[52] U.S. Cl. ..... 2/20; 2/161.1; 2/161.6; 2/167

[58] Field of Search ..... 2/20, 161.1, 161.6, 2/19, 167, 16, 159

[56] References Cited

U.S. PATENT DOCUMENTS

| | | | |
|---|---|---|---|
| 2,077,202 | 4/1937 | Barrie | 31/80 |
| 2,083,935 | 6/1937 | Arnold | 2/161 |
| 3,606,614 | 9/1971 | Dimitroff | 2/159 |
| 3,728,738 | 4/1973 | Andolino | 2/161 |
| 4,287,609 | 9/1981 | Amadeo | 2/16 |
| 4,329,741 | 5/1982 | Bach | 2/161 |
| 4,531,241 | 7/1985 | Berger | 2/161 |
| 4,546,495 | 10/1985 | Castillo | 2/161 |
| 4,561,122 | 12/1985 | Stanley et al. | 2/20 |
| 4,624,016 | 11/1986 | Luevano | 2/20 |
| 4,691,387 | 9/1987 | Lopez | 2/161 |
| 4,700,405 | 10/1987 | Sternberg | 2/19 |
| 4,701,963 | 10/1987 | Overton | 2/161 |
| 4,747,163 | 5/1988 | Dzierson | 2/161 |
| 4,748,690 | 6/1988 | Webster | 2/19 |
| 4,808,469 | 2/1989 | Hiles | 428/318.6 |
| 4,843,651 | 7/1989 | Gramza et al. | 2/161 |
| 4,850,341 | 7/1989 | Fabry et al. | 128/44 |
| 4,864,660 | 9/1989 | Sawyer | 2/161.6 |
| 5,033,119 | 7/1991 | Wiggins | 2/161 |
| 5,070,856 | 12/1991 | Plummer | 124/88 |
| 5,159,717 | 11/1992 | Drew et al. | 2/19 |
| 5,214,799 | 6/1993 | Fabry | 2/161.6 |
| 5,285,529 | 2/1994 | Arena | 2/20 |
| 5,557,803 | 9/1996 | Granich et al. | 2/161.1 |
| 5,581,809 | 12/1996 | Mah | 2/20 |

OTHER PUBLICATIONS

Applicant's Exhibit A; ASTM Designation: D 3574–95; Standard Test Methods for Flexible Cellular Materials—Slab, Bonded, and Molded Urethane Foams; admitted prior art.

Applicant's Exhibit B; E–A–R Specialty Composites: Technical Data Sheet TDS–13; CONFOR™ Ergonomic Urethane Foams; admitted prior art.

*Primary Examiner*—Amy B. Vanatta

*Attorney, Agent, or Firm*—Quarles & Brady

[57] ABSTRACT

A hand glove has a palm panel which extends over the palm of a hand and is made of two webs which envelope a heat softening slow recovery medium density polyurethane foam pad.

7 Claims, 1 Drawing Sheet

PADDED GLOVE

BACKGROUND OF THE INVENTION

FIELD OF THE INVENTION

This invention relates to hand gloves, and particularly to a hand glove having a palm panel padded with a slow recovery foam for better comfort, grip and stability.

Gloves padded with ordinary foam or gel materials for insulation or energy absorption are well known. Ordinary foam, depending on its density and other physical characteristics, tends to exert a reaction force on a user's hand for the entire duration that it is being compressed between the user's hand and an object being grasped. Gel tends to require a higher force to make it conform, has low insulating value and has a tendency to be squeezed out away from the areas of highest force concentration, where cushioning is most needed. Thus, a need exists for an improved padded glove.

SUMMARY OF THE INVENTION

The invention provides a hand glove which has a palm panel with a pad of a slow recovery medium density polyurethane foam material. This pad material reduces the continuous reaction force which the pad exerts on the hand when an object is grasped. The result is to spread gripping loads over a larger area of the hand, stabilize gripping power, reduce fatigue and enhance comfort for a user wearing gloves of the invention. In preferred aspects, the pad is made of a heat softening material that has a low ball rebound characteristic. In addition, the pad is preferably enveloped by inner and outer webs, and may extend onto the thumb and fingers.

Other objects and advantages of the invention will be apparent from the drawings and the detailed description.

DETAILED DESCRIPTION OF THE PREFERRED EMBODIMENTS

Figure 1:
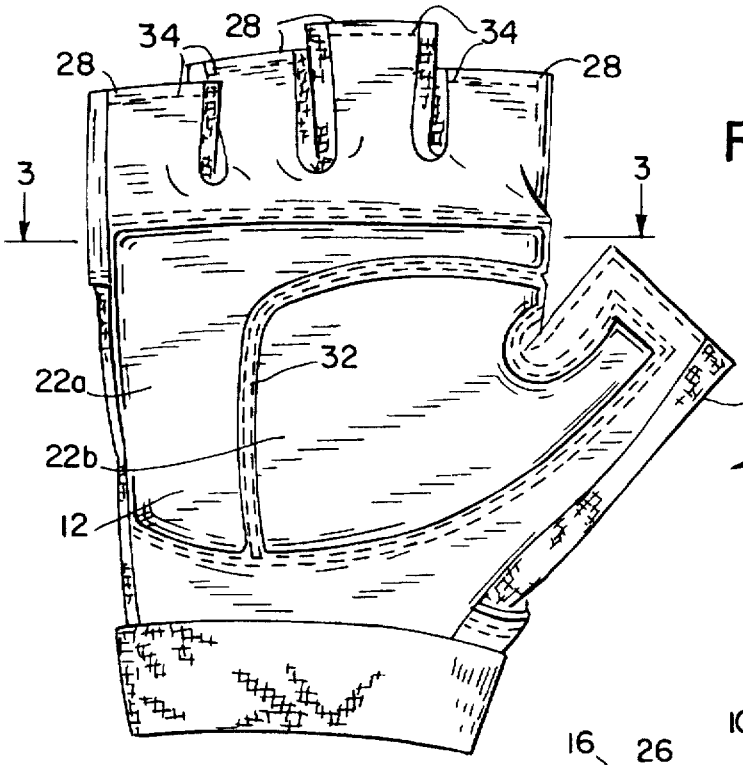
FIG. 1 is a palm side elevation view of a sports glove of the invention.
Figure 3:
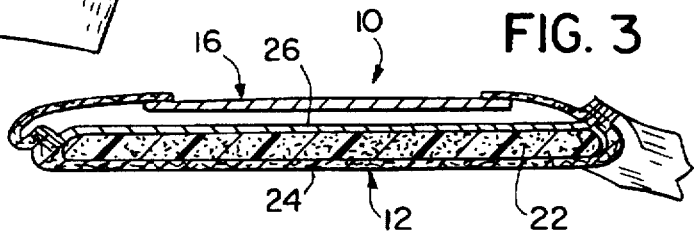
FIG. 3 is a sectional view as viewed from the plane of the line 3—3 of FIG. 1.
Figure 2:
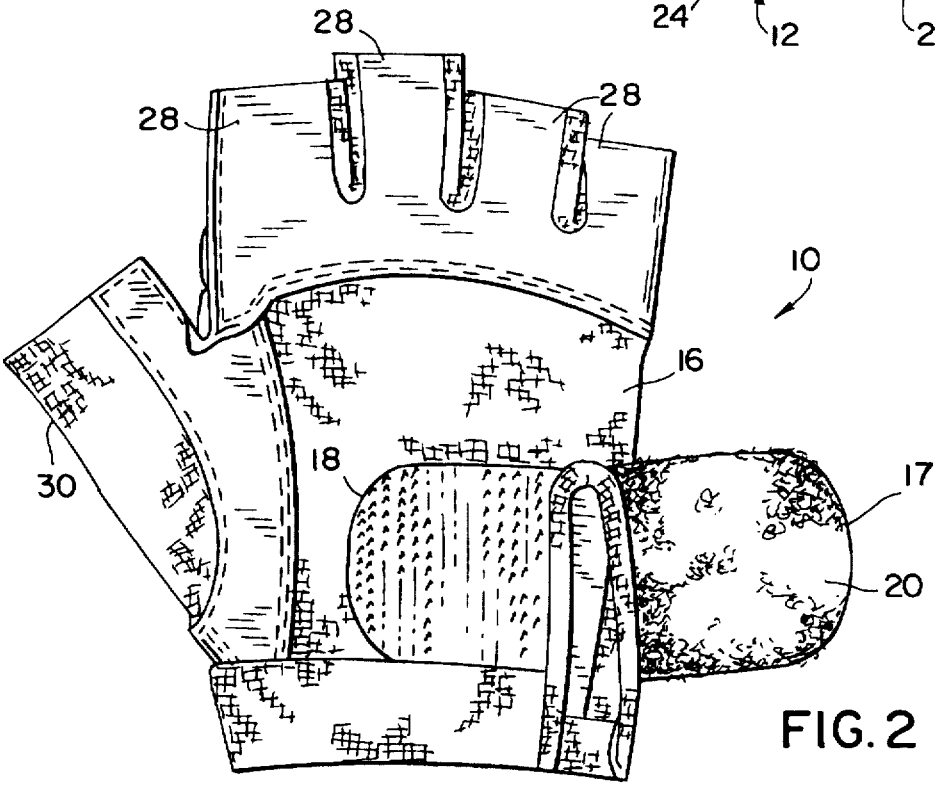
FIG. 2 is a dorsal side elevation view of the glove of FIG. 1.

FIGS. 1–3 illustrate a glove 10 of the invention which includes a palm panel 12 and a dorsal panel 16 which is partially slit and provided with a closure tab 17. A hook and loop type fastener patch 18 is stitched on the exterior surface of the dorsal panel 16 and a mating hook and loop type patch 20 is stitched on the inner side of the tab 17 so as to enable securing the glove 10 on a user's hand, as is conventional.

Referring to FIG. 3, the palm panel 12 includes a pad 22 which is enveloped between two webs 24 and 26 of sheet material. The outer web 24 is preferably leather or a similar non-slip material (this type of material being indicated in FIGS. 1 and 2 by no crosshatching) and the inner web 26 is preferably a soft and breathable fabric material, such as spandex (this type of material being indicated in FIGS. 1 and 2 by crosshatching). In the embodiment disclosed, the finger sleeves 28 and thumb sleeve 30 are truncated and open, although they could be extended and made closed to practice the invention. Although the pad 22 is divided into two areas

22*a* and 22*b* by stitching 32, the pad 22 may be one integral piece, with the stitching 32 compressing the pad 22 in the area of the stitching. Alternatively, the pad 22 could be in two separate pieces, with a dividing line between the two pieces along the stitching 32. In addition, the pad 22 could extend up the fingers, or at least partially up the fingers, if the stitching indicated by phantom lines 34 were provided, so as to envelope the pad in the area of the proximal phalanges of the fingers.

The uniqueness of the glove 10 is in the material which the pad 22 is made of. This material is a slow recovery medium density open cell urethane foam. It is preferably a heat softening foam so that as it is heated by the heat of the hand, it becomes more conforming to the shape and contours of the hand. Since the foam is slow recovery, the pad 22 does not push back against compression to the degree of other foams of the same density. On the other hand, it does not squeeze out to the extent of a gel. The result is a custom-like fit which provides a comfortable and stable grip.

Foam materials suitable for the pad 22 are made by E.A.R. Specialty Composites, Division, Cabot Safety Corporation, Indianapolis, Ind. The material is a crosslinked reaction product of polymethylene polyphenyl isocyanate, water, poly (oxalkylene) polyol, surfactants and pigments. There are five densities of this medium density foam material available, the preferred being ⅛ inch thick material designated CF-42 Pink. Other densities may also be suitable, as may foam materials made by other manufacturers. The specifications of the five densities made by the above supplier are given in Appendix A.

Of particular importance in these specifications is the ball rebound specification, as determined in accordance with the American Society for Testing and Materials (ASTM) Standard D3574. This test consists of dropping a steel ball of a certain size (16 mm) on a specimen of the foam material being tested and noting the height of rebound, which is stated in the table as a percent of the height from which the ball is dropped. The rebound of each of the five specified foam materials is very low, i.e., less than 3%, with the preferred material having a rebound of 1%. Thus all of these materials have a very low fast resilience, which is desired in practicing the present invention. This is desirable so as to reduce the continuous duration of the reactionary force exerted on the user's hand by the foam when the user compresses the foam, as occurs when grasping an item.

While a slow recovery is desirable, a medium density is desired for practicing the invention. All of the densities given in the above table are in the range of 5.5 to 6.5 lb./ft$^3$, with the preferred material being 5.7 lb./ft$^3$. A medium density is desired so that even when the pad is compressed, it still serves to isolate the user to a significant extent from the item being grasped, but is still heat softenable and not excessively hard or stiff.

Which density to select within this range of medium densities will depend on the intended application. A higher density may work better for applications in which a compression force or grip is maintained for a prolonged period of time, for example, riding a bicycle or operating a jack hammer. If the force is of short duration, as is the case if the grip is changed frequently, e.g., in golf or using hand tools, a lower density foam exhibiting a faster recovery may be more desirable. For some applications, for example where the grip may be of short or long duration, it may be desirable to combine two or more sheets of foam of different densities, for example in a laminated construction. The lower density would react more quickly to conform conform to changes in the grip and the higher density would react over a longer period to better cushion a prolonged grip.

Another important characteristic of the foam pad material is its indentation force deflection (IDF), which is given in the table for the five specified materials including the preferred CF-42 Pink material. The preferred material has an IDF of 8 lb. at 21° C., as measured according to ASTM D3574 Test B1 at 25% deflection using a sample size of 3"×4".

The IDF changes dramatically (by more than 90% of the colder temperature value) in going from 10° C. to 21° C., which is characteristic of a heat softening material. Under normal conditions of use, the glove is normally used indoors or in fair weather sports such as bicycling. The ambient temperature of normal use is typically near 21° C. and the pad would be significantly warmer, since it is heated by body temperature. Thus, under normal conditions, the pad 22 has a very low IDF, thereby exerting a very low reaction force on the user's hand.

Preferred embodiments of the invention have been described in considerable detail. Many modifications and variations to the invention will be apparent to those of ordinary skill in the art. Therefore, the invention should not be limited to the embodiments described, but should be defined by the claims which follow.

APPEXNDIX A
CONFOR ™ FOAMS - TYPICAL PROPERTIES

| Property | Test Method | CF-47 Green | CF-45 Blue | CF-42 Pink | CF-40 Yellow | CF-35 Yellow |
|---|---|---|---|---|---|---|
| PHYSICAL PROPERTIES | | | | | | |
| Density Nominal (lb/ft$^3$) | ASTM D3574 | 5.8 | 6.0 | 5.7 | 5.8 | 6.4 |
| Flammability | FMVSS 302 | Meets | Meets | Meets | Meets | Meets |
| | FAR 25.8S5 | Meets | Meets | Meets | Meets | Meets |
| | FAR 25.853(b) | Meets | Meets | Meets | Meets | Meets |
| | UL 94 Rating (@ min 0.25 in) | Listed HBF | Listed HBF | Listed HBF | Listed HBF | Listed HBF |
| Dielectric Strength | ASTM D149 (V/mil) | 27 | 27 | 27 | 27 | 27 |
| Ball Rebound | ASTM D3574 (% Rebound) | 2.8 | 2.4 | 1.0 | 0.9 | |
| Thermal Conductivity, K. | ASTM C177 BTU-in/hr-ft$^2$-deg. F. | 0.28 | 0.28 | 0.28 | 0.28 | 0.28 |
| Volume Resistivity | ASTM D257, (Ohms-cm) | $1.6 \times 10^{13}$ | $1.6 \times 10^{13}$ | $1.6 \times 10^{13}$ | $1.6 \times 10^{13}$ | $1.6 \times 10^{13}$ |
| Impact Absorption | ASTM F355, Modified 11 lb missile, 3.4 m/sec., 24" drop, "G" Max | 70 | 58 | 58 | 75 | 165 |
| Hardness | ASTM D2240, Shore 00 15 sec impact: | | | | | |
| | 4 C. | 91 | 86 | 83 | 79 | 74 |
| | 10 C. | 88 | 80 | 77 | 70 | 60 |
| | 16 C. | 71 | 46 | 21 | | |
| | 21 C. | 20 | 8 | 4 | | |
| | 27 C. | 12 | 5 | 2 | | |
| | 32 C. | 10 | 4 | | | |
| | 38 C. | 8 | 4 | | | |
| STRENGTH PROPERTIES | | | | | | |
| Dimensional Stability | ASTM D1204 | 0% | 0% | 0% | 0% | 0% |
| | GM 6098M | Meets | Meets | Meets | Meets | Meets |
| Tensile Strength (psi) | ASTM D3574, @ 20 in/min 22 C. | 25.2 | 22.3 | 18.1 | 14.6 | 10.7 |
| | 70 C. & 50% RH × 7 days | 25.4 | 18.9 | 14.7 | 7.5 | 6.5 |
| UV Resistance | UVA @ 60 C. (4 hr UV, 4 hr condensation) | 21.1 | 16.5 | 9.9 | 5.8 | 5.6 |
| Elongation (%) | ASTM D3574, @ 20 in/min 22 C. | 98 | 108 | 109 | 135 | 148 |
| | 70 C. & 50% RH × 7 days | 97 | 127 | 149 | 159 | 166 |
| UV Resistance | UVA @ 60 C. (4 hr UV, 4 hr condensation) | 85 | 110 | 129 | 139 | 158 |
| Tear Strength (lbf/in) | ASTM D1004, @ 5 in/min | 2.9 | 2.1 | 1.7 | 0.7 | |
| Tear Resistance (lbf) | ASTM D3574, @ 20 in/min | 5.5 | 4.6 | 3.4 | 1.6 | |
| Compression Set (% deflection from | ASTM D3574 70 C. × 22 hrs | | | | | |
| original height) | Compressed 25% | 0.3 | 0.4 | 0.9 | 0.6 | |
| | Compressed 50% | 0.6 | 0.8 | 1.0 | 2.4 | |
| | ASTM D1667 22 C., 24 hr recovery | | | | | |
| | Compressed 25% | 0.3 | 0.2 | 0.1 | 0.2 | |
| Shear Adhesion (psi) Pressure-Sensitive | ASTM D3163 @ 20 in/min 24 C. & 60% RH × 14 days | | | | | |
| Adhesive (PSA) | On stool | Foam tear | Foam tear | Foam tear | Foam tear | Foam tear |
| | On aluminum | Foam tear | Foam tear | Foam tear | Foam tear | Foam tear |

-continued

APPEXNDIX A
CONFOR ™ FOAMS - TYPICAL PROPERTIES

| Property | Test Method | CF-47 Green | CF-45 Blue | CF-42 Pink | CF-40 Yellow | CF-35 Yellow |
|---|---|---|---|---|---|---|
| Peel Strength (psi) | ASTM D903 | | | | | |
| Pressure-Sensitive | 23 C. & 60% RH × 14 days | | | | | |
| Adhesive (PSA) | On stool | Foam tear | Foam tear | Foam tear | Foam tear | Foam tear |
| | On aluminum | Foam tear | Foam tear | Foam tear | Foam tear | Foam tear |
| Indentation Force Deflection (lbf) | ASTM D3574* Test B1 | | | | | |
| | 25% Deflection: | | | | | |
| | 10 C. | 488 | 315 | 228 | 34 | |
| | 21 C. | 27 | 10 | 8 | 4 | |
| | 38 C. | 9 | 7 | 6 | 3 | |
| ENVIRONMENTAL RESISTANCE PROPERTIES | | | | | | |
| Outgassing | ASTM E595 Modified per Ball Aerospace BASG 33074 | | | | | |
| | 24 hrs @ $10^{-6}$ torr & 70 C. | | | | | |
| | % Weight Loss | 1.3 | 1.4 | 1.7 | 3.1 | |
| | % Volatile Condensable Material | 0.7 | 0.6 | 0.9 | 1.0 | |
| Corrosion Resistance | AMS 3568 | | Good | | | |
| | 80 C. × 5 days | | | | | |
| Water Content | AMS 3568 (% water content) | 0.29 | 0.34 | 0.48 | 0.47 | |
| Water Absorption | AMS 3568 (% water absorption) | 0.79 | 0.80 | 0.91 | 0.89 | |
| Ozone Resistance | ASTM D51 | Good | Good | Good | Good | Good |
| Bacterial Resistance | ASTM G22 | Good | Good | Good | Good | Good |
| Fungal Resistance | ASTM G21 | Good | Good | Good | Good | Good |
| Stain Resistance | ASTM D925 Method A, 96 hrs. @ 70 C. under 1 lb weight | No visible stain | No visible stain | No visible stain | No visible stain | No visible stain |

*Sample size 3" × 4"

I claim:

1. A hand glove, comprising:

a palm panel for extending over the palm of a hand, said palm panel having an exterior surface facing away from the hand and an interior surface facing the hand and including a homogeneous pad of a single material between said exterior and interior surfaces, said pad being a polyurethane foam material with a ball rebound of less than 3% as determined in accordance with ASTM D3574 and a density in the range of 5.5–6.5 $lb/ft^3$ inclusive.

2. A glove as in claim 1, wherein said ball rebound of said pad material is less than or equal to 1%.

3. A glove as in claim 1 wherein said pad is enveloped between two webs of sheet material.

4. A glove as in claim 1, wherein said pad is a heat softening material.

5. A glove as in claim 4, wherein said pad material has an indentation force deflection as determined according to ASTM D3574 Test B1 at 25% deflection using a 3 inch by 4 inch sample size which diminishes by at least 90% when going from 10° C. to 21° C.

6. A glove as in claim 1, wherein said pad extends onto the palmar side of a proximal phalanx of a user's thumb.

7. A glove as in claim 6, wherein said pad extends onto the palmar side of proximal phalanges of a user's fingers.

* * * * *